US005165661A

United States Patent [19]

Wright

[11] Patent Number: 5,165,661

[45] Date of Patent: Nov. 24, 1992

[54] LIFTING TOOL

[76] Inventor: D. Ronnie Wright, 3603 Irwin St., Greensboro, N.C. 27405

[21] Appl. No.: 843,142

[22] Filed: Feb. 28, 1992

[51] Int. Cl.[5] ..... B66F 3/00

[52] U.S. Cl. ..... 254/131

[58] Field of Search ..... 254/30, 131, 132, 133, 254/120, DIG. 1; 294/15, 17, 91, 82.11, 82.13, 74; 414/444, 457, 684.3; 280/47.27

[56] References Cited

U.S. PATENT DOCUMENTS

| | | | |
|---|---|---|---|
| 831,424 | 9/1906 | Fravel | 294/82.13 |
| 2,846,259 | 8/1958 | Sodler | 254/131 |
| 3,152,708 | 10/1964 | Agesen | 254/132 |
| 4,359,241 | 11/1982 | Kistner | 294/82.13 |
| 4,365,786 | 12/1982 | Osteen | 254/131 |
| 4,512,554 | 4/1985 | Racine | 254/131 |

FOREIGN PATENT DOCUMENTS

| | | | |
|---|---|---|---|
| 1126526 | 11/1984 | U.S.S.R. | 294/82.11 |
| 164550 | 6/1921 | United Kingdom | 294/82.13 |

*Primary Examiner*—Robert C. Watson

[57] ABSTRACT

A tool and method are presented whereby a heavy storm drain cover or other object can be easily removed and replaced by an individual workman. The device includes a base having a lever pivotally mounted thereto and an attachment device for the storm drain cover. Once attached the lever is manually lifted causing the cover to raise whereby the user can swivel the lever from side to side to place the cover at a convenient distance. To replace the cover, it is lifted by the lever and is then rotated and lowered over the storm drain opening. A tension device is affixed to the cover attachment to secure it prior to raising by the lever.

11 Claims, 2 Drawing Sheets

LIFTING TOOL

BACKGROUND OF THE INVENTION

1. Field of the Invention

The invention herein pertains to a maintenance tool and more specifically to a tool for lifting, removing or replacing a storm drain cover by an individual workman.

2. Description of the Prior Art and Objectives of the Invention

Storm drain or "manhole" covers are removed and replaced daily by workmen for maintenance, repair and new construction for sewer lines, telephone cables, power lines and the like. With the ever growing desire to "bury" or use underground power lines, municipalities are increasing the numbers of underground conduits and consequently have increased the number of access openings for these conduits. Covers for the openings are generally formed from steel or cast iron and may weigh fifty, seventy-five or more pounds and are difficult to manipulate and particularly for an individual workman to remove or replace prior to entry into the underground conduit. Various forms of manual hooks and rods have been utilized in the past to assist in removing and replacing covers, but without complete satisfaction.

With the aforesaid problems and disadvantages known about prior art devices, the present invention was conceived and one of its objectives is to provide a relatively inexpensive tool for lifting, removing and replacing storm drain covers and the like by a single workman.

It is another objective of the present invention to provide a tool for manipulating storm drain covers which will both pivot and swivel to allow the cover to be placed on either side of the manhole or at another suitable position.

It is still another objective of the present invention to provide a tool for removing a storm drain cover which can easily be adjusted for covers of various sizes and weights.

It is yet another objective of the present invention to provide a method for easily removing, manipulating and replacing storm drain covers in relatively little time with ease and convenience.

Various other advantages and objectives of the invention will become apparent to those skilled in the art as the detailed presentation below is reviewed and understood.

SUMMARY OF THE INVENTION

A tool and method of use are provided whereby a storm drain, manhole cover or the like can be easily lifted and moved to a convenient, out-of-the-way location. The device comprises a base to which a lever is pivotally attached for lifting the cover. The lever is also rotatably joined to the base to allow the cover to be swung in a circular direction. A lever loop is connected at approximately midway along the longitudinal length of the lever to which a plurality of link chains are slidably attached. At the other end of the link chains, hooks are affixed for insertion into the openings in a storm drain cover. The method of use includes a tension ring which is affixed among the link chains to hold the chains onto the cover during times when the cover is supported and tension on the link chains is removed.

DESCRIPTION OF THE PREFERRED EMBODIMENT

Figure 1:
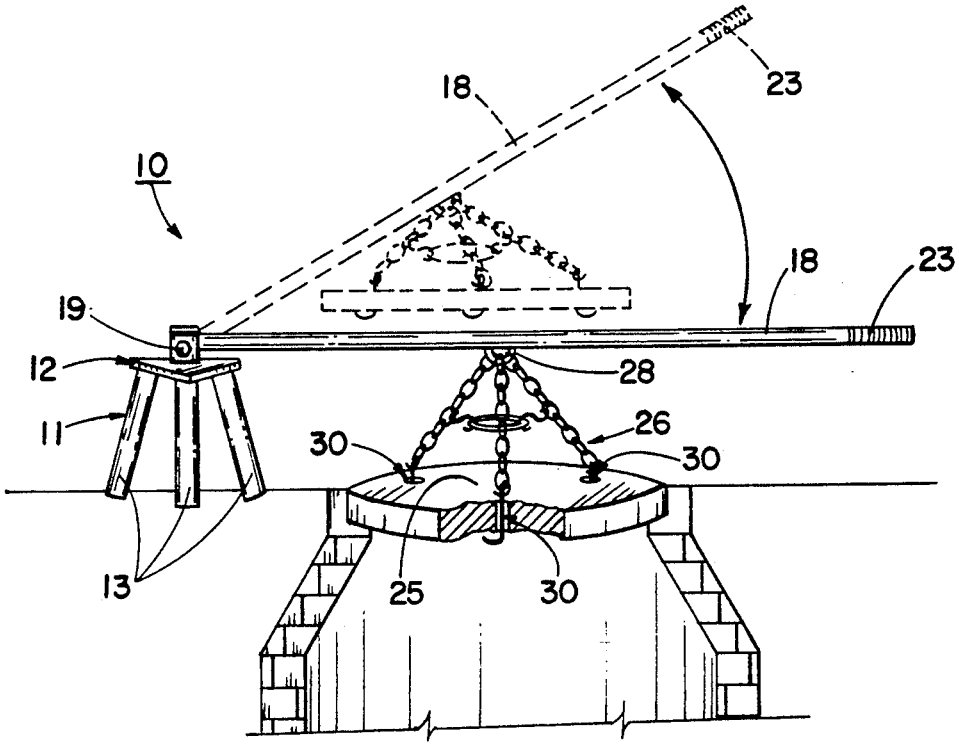
FIG. 1 shows a perspective view of the invention attached to a storm drain cover.
Figure 2:
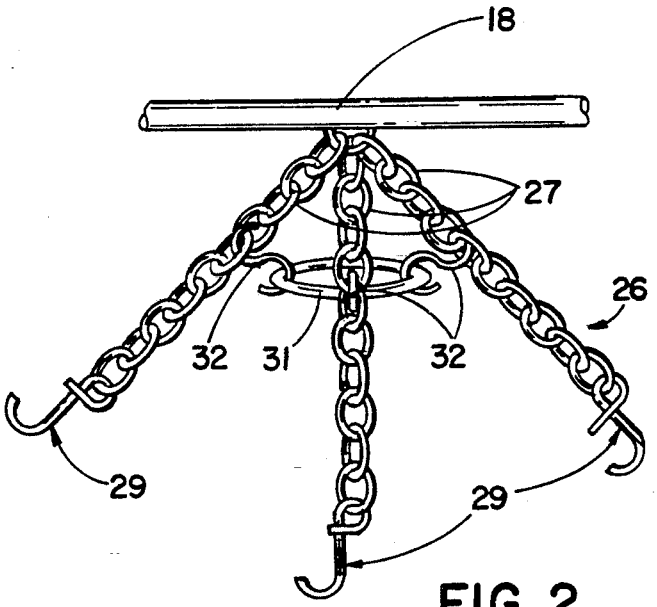
FIG. 2 shows an enlarged view of a section of the lever with the cover attachment affixed thereto.
Figure 3:
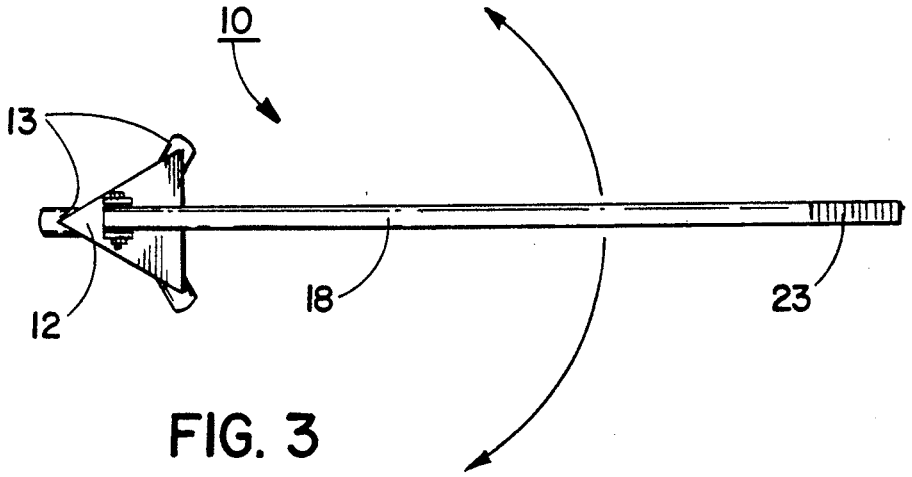
FIG. 3 demonstrates a top view of the invention illustrating the swivel motion of the lever.

The preferred form of the inventive structure is shown in FIGS. 1–4 whereby a triangular planar one-quarter inch thick steel top having a trio of ten inch long legs is pivotally joined to a lever. The triangular top is eight inches in length along each side. The lever may be constructed of one and one-half inch galvanized pipe and may extend for approximately five feet. As shown in FIG. 3, the lever will also swivel or rotate three hundred and sixty degrees in addition to the upward and downward pivotal action shown in FIG. 1. A tension ring is used to hold link chains of the cover attachment securely to a cover as will be hereinafter more fully explained.

In the method of use, the base of the tool is positioned on one side of a storm drain opening, manhole, underground conduit opening and the cover attachment comprising link chains in triplicate which are affixed to the lever approximately midway therealong are releasably joined by S-shaped hooks or the like to the cover. Next, the tension ring is positioned among the link chains of the cover attachment to maintain pressure on the chains to firmly secure them to the cover. With the tension ring thus in place, the lever can then be manually raised and lowered without the attachment chains disengaging from the cover. The lever can be raised and by swivel movement, can rotate around the base to place the cover on the ground at a convenient location for later retrival. Once work has been completed within the storm drain opening, the lever can then be lifted again and the cover quickly replaced over the opening. Next, the tension ring is removed from at least one of the chains and preferrably two, to facilitate removal of the cover attachment or link chins from the cover. The tool can then be moved to another location and reused as required.

DETAILED DESCRIPTION OF THE DRAWINGS AND OPERATION OF THE INVENTION

Turning now to the drawings, as shown in FIG. 1, tool 10 comprises a base 11 with a substantially triangularly shaped planar top 12 with legs 13 which may be approximately ten inches in height joined at the corners of triangular top 12. Legs 13 may be formed from one and three-quarter inch galvanized pipe and may be welded to triangular planar top 12. The triangular shape provides a greater utility and convenience in use while providing strength to the relatively small top 12 than other shapes.

Figure 4:
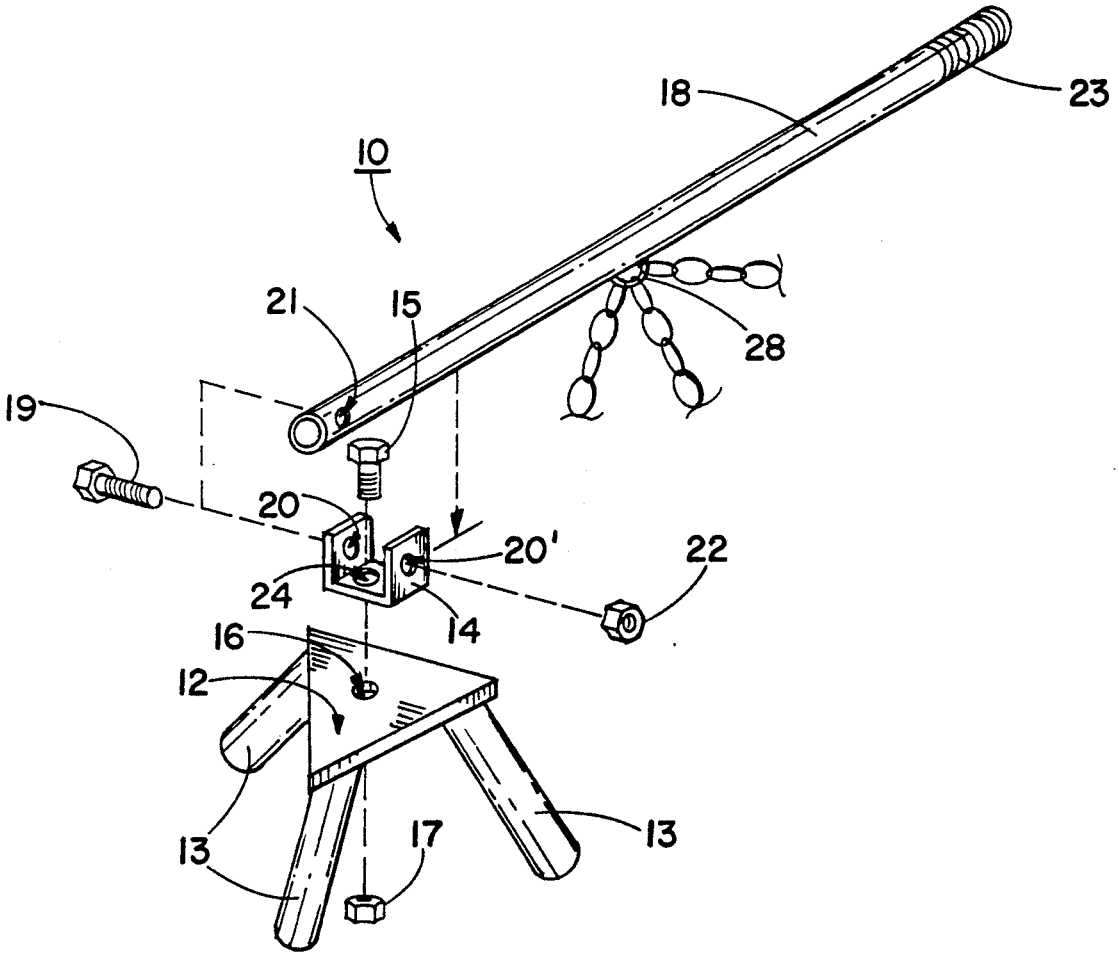
FIG. 4 pictures an exploded view of the invention to better illustrate its construction and assembly.

As further seen, in FIG. 4 swivel bracket 14 is rotatably attached to top 12 by threaded bolt 15 which passes through opening 24 in swivel bracket 14 and continues through top aperture 16 and is secured therein by nut 17. Threaded member 15 is sufficiently loose within aperture 16 to allow bracket 14 to freely rotate. Also, lever 18 which may be for example, formed from galvanized steel pipe is pivotally positioned within bracket 14 as threaded bolt 19 passes through apertures 20, 20' and openings 21, 21' (21' not shown) in lever 18 and is secured therein by nut 22. Thus, lever 18 pivots around threaded bolt 19 within swivel bracket 14 as seen by dotted line configuration in FIG. 1.

Lifting tool 10 as shown in FIG. 1 can be used for lifting a variety of objects such as storm drain cover 25. Cover 25 is lifted by attachment 26 as shown in FIG. 2 which comprises a plurality of fifteen inch long link chains 27 of one inch long links of suitable thickness and strength. Link chains 27 are slidably fastened on lever loop 28 and affixed at the terminal end of each is a three inch long attachment hook 29.

As cover attachment 26 is secured to cover 25 initially, attachment hooks 29 are inserted in apertures or slots 30 of cover 25 which are positioned around the periphery thereof. When link chains 27 are first attached to cover 25, lever 18 is generally in a downward position, perhaps near the ground and therefore no tension is applied to chain links 27. In order to initially hold chain links 27 to cover 25 with attachment hooks 29 which are sized to fit into cover apertures 30, tension ring 31 as seen in FIG. 2 is used. Tension ring 31 consists of a suitable rigid steel ring which may have a cross-sectional thickness of three-eights of an inch and a diameter of three inches. A series of three ring hooks 32 are slidably fastened to ring 31 and are releasably engagable with chain links 27 to provide tension thereto and prevent hooks 29 from inadvertently releasing cover 25. With tension ring 31 so secured, lever 18 can then be raised, pivoted, rotated as seen in FIG. 3 or the like with ease in lifting and manipulating cover 25 without fear of disengagement therefrom.

When it is desired to replace cover 25 over the storm drain opening, lever 18 is grasped by handle 23 and an individual workman can then rotate lever 18 and replace cover 25 with ease. With tension ring 31 so affixed, lever 18 can be moved and cover 25 lifted, rotated, pivoted or deposited without fear of cover 25 accidentally releasing therefrom. As would be understood, cover 25 may weigh fifty, seventy-five or more pounds and can easily cause an accident or injury to nearby workers if inadvertently released from attachment 26.

With the aforesaid method and device sufficiently described, it should be understood by those skilled in the art that variations can be made, but changes will not depart from the intended scope of the invention as set forth in the appended claims since the examples and illustrations are merely for explanatory purposes.

I claim:

1. A lifting tool comprising: a base, an elongated lever, said lever pivotally and rotatably attached at one end to said base, a handle, said handle positioned on the opposite end of said lever, means to attach to an object, said attaching means affixed to said lever, said attaching means comprising a plurality of depending members between said lever ends, a means to tension said depending members, said tensioning means releasably connected to said depending members along the inside thereof.

2. A lifting tool as claimed in claim 1 and including a leg, said leg attached to said base.

3. A lifting tool as claimed in claim 1 and including a plurality of legs, said legs attached to said base.

4. A lifting tool as claimed in claim 1 wherein said attaching means comprises a link chain.

5. A lifting tool as claimed in claim 1 wherein said attaching means comprises a plurality of link chains.

6. A lifting tool as claimed in claim 1 wherein said tensioning means comprises a rigid ring, a plurality of hooks, said hooks slidably attached to said ring.

7. A lifting tool comprising: a base, a lever, said lever pivotally attached to said base, means to attach an object, said attaching means depending from said lever in spatial relation to said base, said attaching means comprising a plurality of link chains, a plurality of fasteners, each of said fasteners joined to one of said chains, means to tension said attaching means, said tensioning means comprising a rigid ring, said ring releasably attached to said plurality of chains, said tensioning means affixed to the inside of said plurality of chains.

8. A lifting tool as claimed in claim 7 wherein said tensioning means comprises a plurality of hooks, said hooks slidably attached to said ring.

9. The method for lifting an object with a tool having a base and a rotatable, pivotable lever attached to said base, said lever having a plurality of depending attachment members with a releasable means for tensioning said attachment members affixed thereto comprising the steps of:

(a) attaching said object to said attachment members, (b) affixing said tensioning means to the inside of said attachment members, and (c) raising the lever to thereby lift the object.

10. The method of claim 9 wherein the step of attaching said object to said lever comprises the step of:

(a)

(b) attaching said object to a trio of attachment members.

11. The method of claim 9 wherein the step of raising the object comprises raising the lever manually.

* * * * *